US006520489B1

(12) United States Patent
Morris

(10) Patent No.: US 6,520,489 B1
(45) Date of Patent: Feb. 18, 2003

(54) THROTTLE CONTROL FOR HAND-HELD BLOWERS

(75) Inventor: Richard L. Morris, Franklin, TN (US)

(73) Assignee: Zama Japan (JP)

( * ) Notice: Subject to any disclaimer, the term of this patent is extended or adjusted under 35 U.S.C. 154(b) by 0 days.

(21) Appl. No.: 09/823,381

(22) Filed: Mar. 29, 2001

(51) Int. Cl.[7] ..... F02M 9/12
(52) U.S. Cl. ..... 261/65; 74/533
(58) Field of Search ..... 261/65; 123/403, 123/376, 391, 392; 74/473.25, 532, 533, 540

(56) References Cited

U.S. PATENT DOCUMENTS

| | | | | | |
|---|---|---|---|---|---|
| 3,199,530 | A | * | 8/1965 | Svendsen | 261/65 X |
| 4,155,270 | A | * | 5/1979 | Juy | 74/533 X |
| 4,351,279 | A | | 9/1982 | Wick | 123/391 |
| 4,438,658 | A | | 3/1984 | Carlson | 74/523 X |
| 4,455,886 | A | | 6/1984 | Schmitt | 74/531 |
| 4,616,518 | A | * | 10/1986 | Nusser | 261/65 X |
| 4,779,480 | A | * | 10/1988 | Stocker | 261/65 X |
| 4,949,591 | A | | 8/1990 | Roelle | 74/531 |
| 5,000,059 | A | | 3/1991 | Barnard | 74/523 |
| 5,215,049 | A | * | 6/1993 | Wolf | 261/65 X |
| 5,524,501 | A | | 6/1996 | Patterson et al. | 74/475 |
| 5,921,140 | A | | 7/1999 | Lemmens | 74/473.28 |
| 6,042,132 | A | | 3/2000 | Suenaga et al. | 280/260 |
| 6,042,133 | A | | 3/2000 | Leiter et al. | 280/260 |
| 6,070,487 | A | | 6/2000 | Beugelsdyk et al. | 74/502.2 |
| 6,085,612 | A | | 7/2000 | Thorn et al. | 74/531 |

* cited by examiner

*Primary Examiner*—Richard L. Chiesa
(74) *Attorney, Agent, or Firm*—Orrick, Herrington & Sutcliffe, LLP

(57) ABSTRACT

A carburetor throttle control device is provided having a positive feel and ability to precisely position a throttle valve. The lever includes an annular rim that has a plurality of notches corresponding to the angular positions of the throttle plate. A detent is piloted over the throttle shaft and is fixed or captured relative to the carburetor body between the carburetor body and the throttle lever, received in the annular recess of the hub. The detent includes a flexible or spring-type arcuate arm attached to and extending about a portion of the hub and having a protrusion extending therefrom. As the lever is rotated, the protrusion mates with the throttle position notches in the hub of the lever. The protrusion thus positively indexes the lever between positions. A throttle adjustment mechanism is also provided for manually adjusting the position of the detent, and thus the idle speed of the engine.

33 Claims, 3 Drawing Sheets

THROTTLE CONTROL FOR HAND-HELD BLOWERS

FIELD OF THE INVENTION

The invention relates generally to throttle control systems for two-cycle engine drive hand-held blowers and, in particular, to throttle control systems for hand-held blowers in which the throttle lever is positively indexed at small incremental angles.

BACKGROUND OF THE INVENTION

Existing low cost hand-held blowers use throttle control levers mounted directly to the throttle shaft, and they typically have three settings: Closed, Idle, and Wide Open Throttle (WOT). The throttle positions can be described as an angular rotation of the handle about the shaft from the Closed position. For example, in existing blowers, the throttle position at the Idle setting is approximately 35° from the Closed position.

An optimum fuel ratio is the fuel-air mixture that will achieve the highest engine speed (measured in revolutions per minute, or RPM) at a given throttle setting. For an optimum fuel mixture and a throttle position of 35° (the current Idle position), the speed of the blower would be too fast. Previous blowers lowered their Idle speed by increasing the fuel ratio at the Idle position. A fuel-rich setting causes inefficient combustion, which in turn lowers the Idle speed; however, the fuel-rich setting also increases emissions from these blowers. Because of new emissions regulations for hand-held blowers specifying that idle emissions account for 15% of the total emissions limit, fuel mixtures cannot be set as rich as they have previously been.

When the fuel mixture is set at the optimum level, the speed of the blower for a given throttle opening will increase. The blower's Idle speed can be lowered by setting the Idle position so that throttle opening is less open. Whereas fuel-rich blowers had an Idle position at around 35°, blowers having an optimal fuel ratio must have an Idle position in an approximate range of 4° to 14° (preferably, 10° to 14°) to maintain an appropriate Idle speed, approximately 4000 RPM.

But existing throttle controls cannot hold the throttle at such a small open position. It is desirable for a throttle to "snap" into place as it moves between positions. To achieve this desired feel, existing throttle controls use a spring-loaded steel ball in the carburetor body that falls into a drilled detent in the throttle shaft. Because of the small shaft diameter and the size of the steel ball, the detents corresponding to the Stop and Idle positions would overlap too much to function effectively.

SUMMARY OF THE INVENTION

The present invention is directed to throttle control systems for carburetors.

In accordance with one embodiment of the invention, a throttle control system for a carburetor comprises a throttle valve, a throttle valve shaft rotatably received in the carburetor, a throttle lever, and a detent. The throttle lever comprises an arm and a hub, the hub formed by an annular recess circumscribed by an annular rim, wherein notches are formed on the inside of the annular rim. The detent comprises an annular hub and a flexible arcuate arm extending about a portion of the hub, and from the arcuate arm extends a protrusion shaped to mate with the notches of the throttle lever hub. The detent is piloted over the throttle valve shaft and fixed to or captured relative to the carburetor, and the throttle lever is fixed to the throttle valve shaft so that the detent is at least partially located within the lever hub annular recess. As the throttle lever is rotated with respect to the carburetor, the notches of the throttle lever hub move with respect to the protrusion of the detent, and when one of the notches indexes the protrusion, the protrusion mates with the notch, thereby positively indexing the lever.

In accordance with another aspect of a preferred embodiment, the annular rim of the throttle control lever has at least two notches located within an arc distance of 14° along the annular rim. In accordance with another aspect of a preferred embodiment, the throttle lever includes a stop that prevents the lever from being rotated past one or both of the Closed or WOT positions.

In accordance with another aspect of the preferred embodiments, a mechanism for making minor adjustments to the idle position of the carburetor is provided. Provided is a first member moveable with respect to the detent in a first direction to contact the rigid arm, and further moveable in the first direction to displace the rigid arm in a second direction substantially transverse to the first direction, thereby causing the flexible arm to bend and the detent to rotate relative to the carburetor. This changes the angular position at which the detent indexes the throttle lever, thus slightly changing the idle state of the carburetor. This mechanism also allows for variations of the idle states that arise from manufacturing tolerances to be fixed.

Implementing the detent on the throttle valve shaft has several advantages over implementing it remotely from the shaft. By keeping the detent means close to the throttle valve shaft, "play" in the system is minimized and the performance of the control system is thus improved. This leads to more accurate positioning and, ultimately, to a better user feel when accessing the throttle positions. Further, control systems implemented remotely from the carburetor are less reliable than systems that implement the system in the carburetor.

Other aspects and features of the present invention will become apparent from consideration of the following description taken in conjunction with the accompanying drawings.

DETAILED DESCRIPTION OF THE PREFERRED EMBODIMENTS

Figure 1:
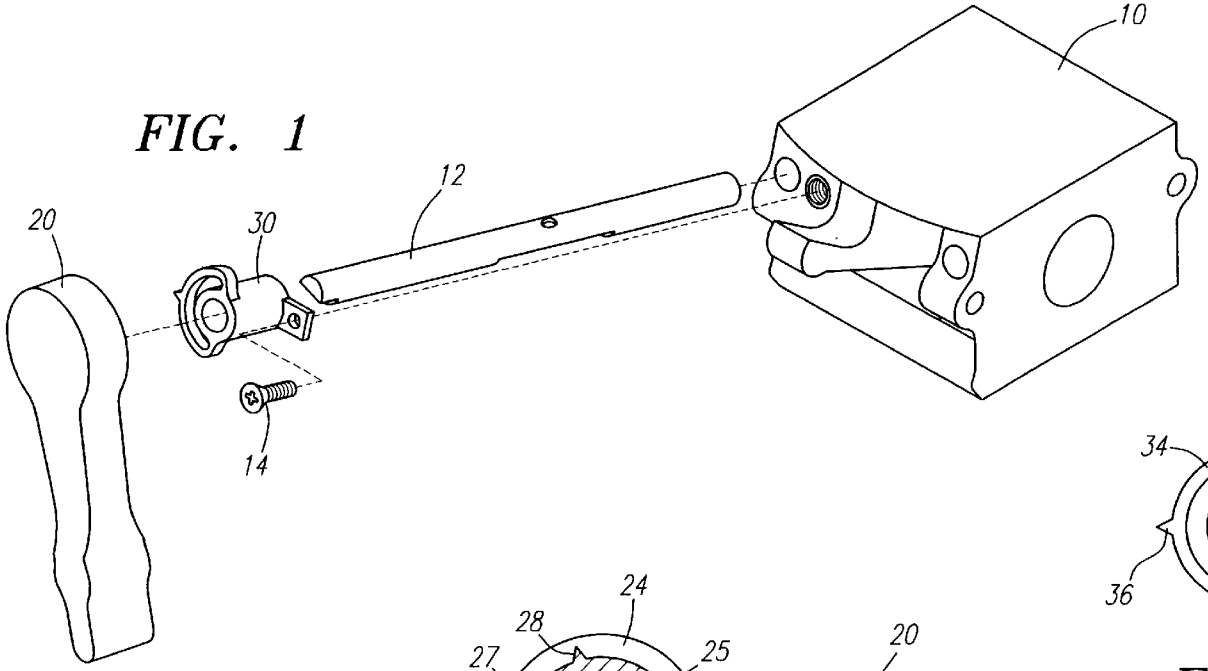
FIG. 1 is an exploded assembly view of the carburetor, throttle valve shaft, throttle lever, and detent according to a preferred embodiment.

A throttle control assembly for a carburetor is shown expanded in FIG. 1. The assembly comprises a carburetor 10, and protruding from the carburetor 10 is a throttle valve shaft 12. The carburetor 10 is designed so that turning the throttle valve shaft 12 about its axis opens and closes a throttle valve (not shown).

In accordance with one embodiment, the carburetor 10 is designed having an optimal fuel-air ratio, at least in its Idle position, wherein the optimal ratio is that which will result in the highest engine speed for a given throttle position. In a typical carburetor, this fuel ratio can be adjusted using the idle mixture adjustment (not shown). Typically, an appropriate Idle speed is approximately 4000 RPM. If the fuel-air mixture is fixed (to the optimal level, in this case), a desired Idle speed can be achieved by setting the throttle position to an appropriate angle. In the case of a typical throttle control system for a hand-held blower, the appropriate throttle position for Idle is approximately 4° to 14° (preferably, 10° to 14°).

Figure 2:
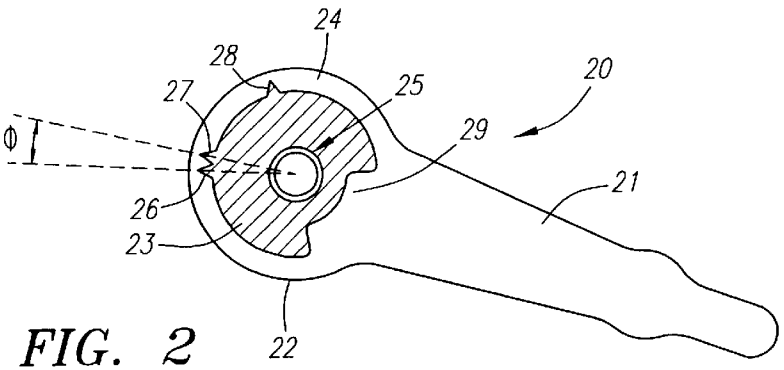
FIG. 2 is a bottom view of the throttle lever.

A throttle lever 20 is provided to facilitate the turning of the throttle valve shaft 12. As depicted in FIG. 2, the lever 20 has an arm section 21 and a hub section 22. The arm section 21 delivers torque that a user applies from the lever arm 21 to the hub 22 and, ultimately, to the valve shaft 12. Therefore, the arm 21 is preferably designed to provide an ergonomic grip for a user. It can be appreciated that various designs for the arm 21 are possible without departing from the inventive concepts contained herein.

The hub section 22 of the lever 20 comprises an annular recess 23 circumscribed by an annular rim 24. The annular recess 23 and annular rim 24 can be formed by removing a portion of the hub 22. Further circumscribed by the annular recess 23 and annular rim 24 is a shaft port 25. The shaft port 25 is designed to receive the throttle valve shaft 12 and fix the shaft 12 relative to the throttle lever 20. In a preferred embodiment, the annular hub 24, annular recess 23, and shaft port 25 are generally concentric, thus facilitating rotary motion.

The port 25 must fix the shaft 12 to the lever 20 so that the torque applied to the lever 20 will be translated to the valve shaft 12. It can be appreciated by persons skilled in the art that various fixing means can be provided to achieve this end. For example, a portion of the shaft 12 could be cut away, exposing a flat face. The port 25 could then be designed to mate with that flat face of the shaft 12, thereby delivering torque to that face of the shaft. Alternatively, the port 25 and shaft 12 could be pinned together, glued, and/or press fitted to effect the required fixing means.

On the inside face of the annular rim 24, facing the annular recess 23, several notches 26,27,28 are cut. In a preferred embodiment, these notches are wedge-shaped and are designed to mate with the detent 30 described below. In a preferred embodiment, the notches 26,27,28 correspond to throttle positions Closed, Idle, and Wide Open Throttle (WOT), respectively. It can be appreciated that notches could be provided for any desired position of the throttle lever 20. For example, an Intermediate throttle setting (above Idle, but not quite WOT) could be provided by adding a notch along the annular rim 24 intermediate notches 27 and 28.

Because it is now desired to place the Closed and Idle throttle positions relatively close together, as explained above, angle $\phi$ is correspondingly small. Angle $\phi$ corresponds to the angle that the lever 20 is rotated from the Closed position to the Idle position, and angle $\phi$ is also the arc distance along the rim 24 between notches 26 and 27. In a preferred embodiment, angle $\phi$ is between 4° and 14°. Decreasing angle $\phi$ brings the notches 26,27 closer, perhaps overlapping, which may diminish the feel of the throttle when moving the lever 20 between the Closed and Idle positions. Therefore, in another preferred embodiment, angle $\phi$ is between 10° and 14° to maintain good feel, or feedback to the user. It can be appreciated that, for a given size and shape notch, a larger diameter annular rim 24 allows notches to be placed smaller arc distances apart without having the notches overlap. Therefore, the hub 22 of the lever 20 can be enlarged to achieve finer throttle settings (i.e., a smaller angle $\phi$) while maintaining good feel.

Figure 3:
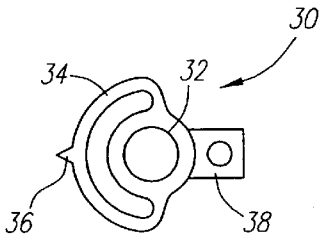
FIG. 3 is a top view of the detent according to a preferred embodiment.

FIG. 3 illustrates the detent 30 that fits inside the throttle lever 20 as shown in FIG. 1. The detent 30 comprises an annular hub 32, the inner diameter of which is designed to allow the throttle valve shaft 12 to pass through. Attached to and extending about a portion of the annular hub 32 is a flexible arcuate arm 34. A protrusion 36 extends radially outward from the arcuate arm 34, and the protrusion 36 is shaped to mate with the notches 26,27,28. The detent 30 further includes an anchor 38 having a hole drilled therethrough. As the assembly drawing of FIG. 1 shows, the detent 30 is fixed to the carburetor body 10 by a screw 14 through the anchor 38 and into the carburetor 10. Although this embodiment includes a screw 14, it can be appreciated that various fastening means known in the art can be used to fasten the detent 30 to the carburetor 10. For example, a pin might be used in place of the screw 14, wherein the pin is piloted through a hole in the anchor 38 and into a hole in the carburetor 10. The pin fixes the rotation of the detent 30 relative to the carburetor, and the detent 30 is fixed in the direction of the axis of the pin by being captured within the annular recess 23 of the throttle lever 20, as described below.

The detent 30 is designed to fit at least partially within the annular recess 23 of the throttle lever 20. In a preferred embodiment, the detent 30 is fixed to the carburetor 10. The lever 20 is placed over the detent 30 so that the detent 30 is at least partially located within the annular recess 23 of the lever 20, and the lever 20 is fixed to the shaft 12 as described above. The shaft 12 and lever 20 are thus rotatable with respect to the carburetor 10 and detent 30.

Figure 4A:
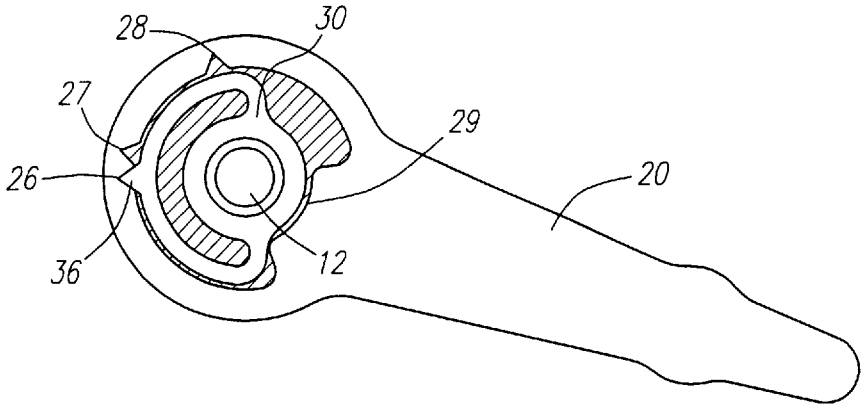
FIGS. 4*a–c* are bottom views of the throttle lever and detent assembly as the lever is rotated to engage the detent in the Closed, Idle, and WOT positions, respectively, according to a preferred embodiment.
Figure 4B:
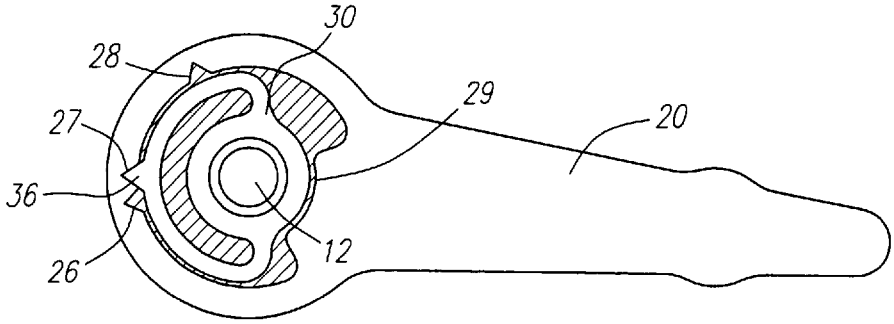
Figure 4C:
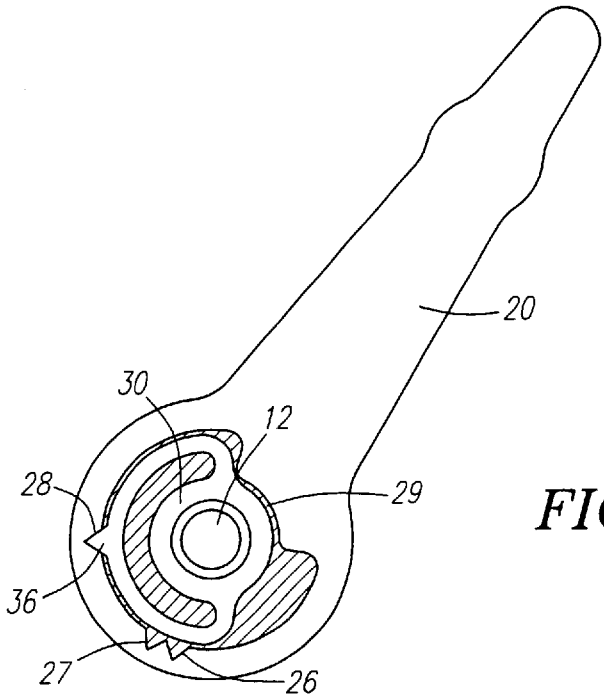

FIGS. 4*a*, 4*b*, and 4*c* show the lever 20 and detent 30 assembly in its three throttle positions according to a preferred embodiment. When the protrusion 36 of the detent 30 is not aligned with one of the notches 26,27,28 of the lever 20, the annular rim 24 pushes the protrusion 36 (and thus the arcuate arm 34) inward towards the valve shaft 12. The arcuate arm 34 must therefore be made of a resilient material so that it acts as a spring, tending to push the protrusion 36 back towards the annular rim 24. When the lever 20 is rotated about the detent 30 so that one of the notches 26,27,28 align with the protrusion 36, the spring action of the arcuate arm 34 forces the protrusion 36 into the notch 26,27,28. With the protrusion 36 mating with a notch 26,27,28, it can be appreciated that an extra torque is required to turn the lever 20 as compared with when the protrusion 36 is not in a notch 26,27,28. Because of the extra torque required to turn the lever 20, the notches 26,27,28 tend to positively index the lever 20 in certain, predetermined positions depending on the placement of the notches 26,27,28.

Referring to FIG. 4*a*, the lever 20 is shown in a Closed/Stop position, as the protrusion mates with notch 26. When the lever 20 is rotated a small angle $\phi$, the protrusion 36 mates with notch 27, thus indexing the lever 20 in the Idle position as shown in FIG. 4*b*. In this position, the valve shaft 12 opens the throttle enough to drive the associated engine at an appropriate idle speed (approximately 4000 RPM). As FIG. 4*c* illustrates, further turning the lever 20 until the protrusion 36 mates with notch 28 indexes the lever in the WOT position. In this position, the throttle is completely open. It can be appreciated to persons skilled in the art that a notch can be placed anywhere along the annular rim 24 to index the throttle lever 20 in any desired throttle position.

Because the lever 20 and detent 30 move against each other, it is desirable to choose materials for them that will minimize wear. Also, as explained, the detent must be at least partially constructed of a resilient material so that the arcuate arm 34 will act as a spring. Delrin and nylon are suitable materials for these purposes; however, many other materials could be used depending on the design requirements.

In accordance with another aspect of the preferred embodiment, a stop 29 is provided on the throttle lever 20. The stop 29 partially fills the annular recess 23 so that when the lever 20 is in the Closed position, the stop 29 engages the detent 30 and thus prevents the lever 20 from being further rotated, as FIG. 4*a* illustrates. The stop 29 can also be designed so that when the lever 20 is in the WOT position, the stop 29 engages the detent 30 and thus prevents the lever 20 from being further rotated in that direction, as illustrated in FIG. 4*c*. Alternatively, a stop could be implemented on the carburetor 10 to limit movement of the lever 20.

It can be appreciated by persons skilled in the art that various types of notch-protrusion combinations can be implemented without departing from the inventive concepts disclosed herein. For example, the notches and protrusion could be semicircular or trapezoidal. Or, several protrusions could extend from the annular rim 24, and the arcuate arm 34 could be designed to mate with the protrusions. Additionally, rather than using a stop 29 to prevent the lever 20 from moving past the Closed or WOT positions, a deeper and/or differently shaped notch could be used. Such a notch would be designed so that the protrusion could only exit the notch in one direction, thereby making movement past the notch difficult or impossible.

Furthermore, it can be appreciated by persons skilled in the art that varying the detent force, shape, style, and material will vary the feel of the throttle control. These variables reflect design choices that can be adjusted to give the best feel to a user of the throttle control described herein, and such modifications are within the scope of the present disclosure.

Figure 5:
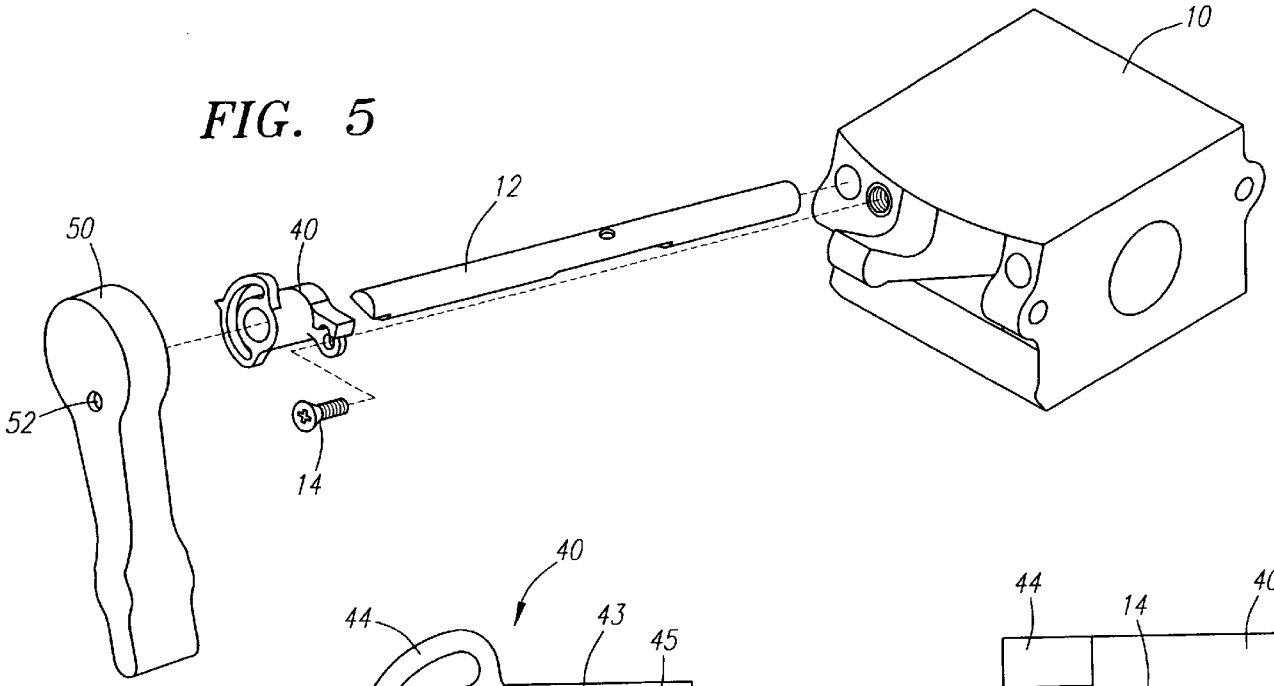
FIG. 5 is an exploded assembly view of the carburetor, throttle valve shaft, throttle lever, and detent according to another preferred embodiment.

According to an aspect of a preferred embodiment, a tuning mechanism for making slight adjustments to the idle speed is provided. A modified detent 40 is provided (see FIG. 6) that is similar to detent 30, having a hub section 42, arcuate arm 44, and protrusion 46 extending therefrom. The detent 40 also includes an anchor 48, but unlike the anchor 38 of detent 30, this anchor 48 is attached to the detent 40 by a flexible arm 41. As the assembly drawing of FIG. 5 shows, the detent 40 is fixed to the carburetor 10 by a screw 14 through the anchor 48 into the carburetor 10. The detent 40 further includes a rigid arm 43 attached to the hub 42 and extending therefrom. The arm 43 has a conical cutout 45 aligned so that the screw 14 (preferably having a conical head) substantially mates with the cutout 45 when the screw 14 is inserted through the anchor 48 and tightened into the carburetor body 10.

Figure 7:
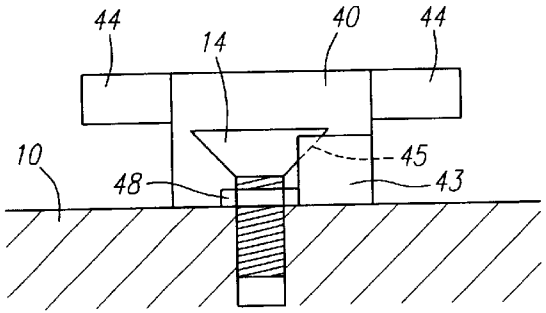
FIG. 7 is a side view of the detent of FIG. 6.

Referring to FIG. 7, as the screw 14 is turned clockwise (defined as from the perspective of facing the head of the screw 14) it moves into the carburetor 10 until its head mates with the conical cutout 45 of the rigid arm 43. As the screw 14 is then turned and moves farther into the carburetor, it can be seen that the conical head of the screw 14 moves against the conical cutout 45, exerting a force on the rigid arm 43. The screw 14 acts as a wedge between the rigid arm 43 and the anchor 48. The flexible arm 41 of the anchor 48 is proportioned so that it has a much smaller cross sectional area than the rigid arm 43; therefore, in response to the separating force of the screw 14, the flexible arm 41 undergoes substantially more deformation than the rigid arm 43.

The flexible arm 41 is held in place relative to the carburetor 10 by the screw 14. When the screw 14 is tightened, the rigid arm 43 is displaced by the screw 14. Because the rigid arm 43 is fixed to the detent 40, the detent 40 pivots around the throttle shaft 12 and the flexible arm 41 thus deflects. In this way, the angular position of the detent 40—and thus the protrusion 46 of the detent 40—about the throttle shaft 12 can be finely tuned. By changing the angular position of the protrusion 46, the angle at which the detent 40 indexes the lever 50 in its idle position is changed, which results in a small modification of the idle speed of the engine.

Figure 6:
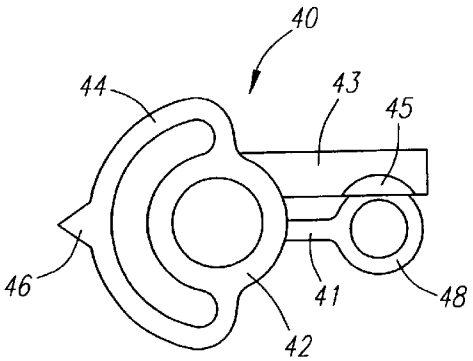
FIG. 6 is a top view of the detent according to another preferred embodiment.

Alternatively, detent 40 could be rotationally fixed relative to the carburetor by a pin, instead of a screw 14, and further captured relative to the carburetor 10 by the throttle lever 50. In such an embodiment, another member is provided to contact the rigid arm 43 and thus rotate the detent 40 as described above. In a preferred embodiment, this member is a screw having a sloped head (as shown in FIGS. 6 and 7), and the control system is adapted so that the sloped head of the screw contacts and displaces the rigid arm when it is screwed into the carburetor 10. In addition, the flexible arm 41 in this embodiment preferably provides an extension for applying friction to the adjustment screw 14 to prevent it from turning after being set. Such an extension may consist of an arm that is adapted to contact the screw (e.g., in a "U" shape that wraps partially around the screw) and thus apply friction thereto.

Preferably, the lever 50 has an access port 52 allowing access to the screw 14 while the throttle control is assembled. The access port 52 is aligned so that it is substantially aligned with the screw 14 and anchor 48 when the lever 50 is rotated to the idle position. In this way, a user can access the screw 14 to make small adjustments to the idle speed of the engine while it is idling, giving the user feedback on the effect of the adjustment.

While the invention is susceptible to various modifications and alternative forms, a specific example thereof has been shown in the drawings and is herein described in detail. It should be understood, however, that the invention is not to be limited to the particular form disclosed, but to the contrary, the invention is to cover all modifications, equivalents, and alternatives falling within the spirit and scope of the appended claims.

What is claimed is:

1. A throttle control system for a carburetor comprising:

a throttle valve shaft attachable to a throttle valve of the carburetor;

a throttle lever having an arm section and a hub section, the hub section comprising an annular recess circumscribed by an annular rim, wherein a first notch, a second notch, and a third notch are formed in the annular rim; and a detent rotationally fixable relative to the carburetor, the detent comprising a protrusion shaped to mate with each of the first, second, and third notches in the annular rim, wherein the throttle valve shaft is rotatable with respect to the detent, the hub section of the throttle lever is fixed to the throttle valve shaft, and the detent is at least partially located within the annular recess of the hub section of the throttle lever, and further wherein when the throttle lever is rotated with respect to the detent, the first, second, and third notches of the throttle lever move with respect to the protrusion of the detent, and when one of the first, second, and third notches indexes the protrusion, the protrusion mates with the one of the first, second, and third notches, thereby indexing the throttle lever, and wherein when the protrusion mates with the first notch, the throttle lever is in a closed position, when the protrusion mates with the second notch, the throttle lever is in an idle position, and when the protrusion mates with the third notch, the throttle lever is in a wide open position.

2. The throttle control system of claim 1, wherein the detent further comprises an annular hub and a flexible arcuate arm, wherein the annular hub has an inner diameter through which the throttle valve shaft is inserted, the arcuate arm is attached to the annular hub and extends about at least a portion of the annular hub, and the protrusion is attached to the arcuate arm and extends radially outward from the annular hub.

3. The throttle control system of claim 1, wherein the detent is rotationally fixed relative to the carburetor by a pin.

4. The throttle control system of claim 1, wherein at least two of the at least two notches of the annular rim of the throttle lever are within an arc distance of 14° along the annular rim.

5. The throttle control system of claim 4, wherein when the throttle lever is rotated so that a first notch of the at least two notches indexes the protrusion of the detent, the throttle valve is closed.

6. The throttle control system of claim 5, wherein when the throttle lever is rotated so that a second notch of the at least two notches indexes the protrusion of the detent, the throttle valve is in an idle state.

7. The throttle control system of claim 6, wherein a third notch is formed in the annular rim, and wherein when the throttle lever is rotated so that the third notch indexes the protrusion of the detent, the throttle valve is wide open.

8. The throttle control system of claim 1, the throttle lever further comprising a stop, wherein when the throttle lever is rotated in a first direction so that the throttle valve is closed, the stop engages the detent and prevents the throttle lever from being further rotated in the first direction.

9. The throttle control system of claim 1, the throttle lever further comprising a stop, so that when the throttle lever is rotated in a second direction so that the throttle valve is wide open, the stop engages the detent and prevents the throttle lever from being further rotated in the second direction.

10. The throttle control system of claim 1, wherein the angular position of the detent about the throttle valve shaft is manually adjustable, thereby allowing the idle state of the throttle valve to be adjusted.

11. The throttle control system of claim 10, the detent further comprising:

a hub;

a rigid arm attached to the hub of the detent and extending therefrom;

a flexible arm having a proximal end attached to the hub of the detent and a distal end extending from the detent, the distal end attachable to the carburetor; and a first member move able with respect to the detent in a first direction to contact the rigid arm, and further moveable in the first direction to displace the rigid arm in a second direction substantially transverse to the first direction, thereby causing the flexible arm to bend and the detent to rotate relative to the carburetor.

12. The throttle control system of claim 11, wherein the first member comprises a screw having a slanted head, the screw being adapted to screw into the carburetor and thereby move relative to the rigid arm of the detent.

13. The throttle control system of claim 12, wherein the throttle lever further comprises a hole that substantially aligns with the screw when the throttle lever is in a position corresponding to an idle state of the throttle valve, thereby allowing access to the screw.

14. The throttle control system of claim 1, wherein the first and second notches are separated by an arc distance of approximately between 4° and 14°, and wherein the first and third notches are separated by an arc distance greater than 14°.

15. A throttle control system for attaching to and rotating a throttle valve shaft of a carburetor, the throttle valve shaft operationally coupled to a throttle valve of a carburetor so that rotating the throttle valve shaft with respect to the carburetor opens or closes the throttle valve, the throttle control system comprising:

a throttle lever attachable to the throttle valve shaft, the throttle lever having an arm section and a hub section, the hub section comprising an annular recess circumscribed by an annular rim, wherein a first notch, a second notch, and a third notch are formed in the annular rim; and a detent rotationally fixable relative to the carburetor, the detent comprising a protrusion shaped to mate with each of the first, second, and third notches in the annular rim, wherein the detent is at least partially located within the annular recess of the hub section of the throttle lever, and wherein when the throttle lever is rotated with respect to the detent, the first, second, and third notches of the throttle lever move with respect to the protrusion of the detent, and when one of the first, second, and third notches indexes the protrusion, the protrusion mates with the one of the first, second, and third notches, thereby positively indexing the throttle lever, and wherein when the protrusion mates with the first notch, the throttle lever is in a closed position, when the protrusion mates with the second notch, the throttle lever is in an idle position, and when the protrusion mates with the third notch, the throttle lever is in a wide open position.

16. The throttle control system of claim 15, wherein the detent further comprises an annular hub and a flexible arcuate arm, wherein the annular hub has an inner diameter large enough to allow the throttle valve shaft to be inserted therethrough, the arcuate arm is attached to and extends about at least a portion of the annular hub, and the protrusion is attached to the arcuate arm and extends radially outward from the annular hub.

17. The throttle control system of claim 15, wherein at least two of the at least two notches of the annular rim of the throttle lever are within an arc distance of 14° along the annular rim.

18. The throttle control system of claim 17, wherein when the throttle lever is rotated so that a first notch of the at least two notches indexes the protrusion of the detent, the throttle valve is closed.

19. The throttle control system of claim 18, wherein when the throttle lever is rotated so that a second notch of the at least two notches indexes the protrusion of the detent, the throttle valve is in an idle state.

20. The throttle control system of claim 15, the throttle lever further comprising a stop, wherein when the throttle lever is rotated in a first direction so that the throttle valve is closed, the stop engages the detent and prevents the throttle lever from being further rotated in the first direction, and when the throttle lever is rotated in a second direction so that the throttle valve is wide open, the stop engages the detent and prevents the throttle lever from being further rotated in the second direction.

21. The throttle control system of claim 15, wherein the angular position of the detent about the throttle valve shaft is manually adjustable, thereby allowing the idle state of the throttle valve to be adjusted.

22. The throttle control system of claim 21, the detent further comprising:

a hub;

a rigid arm attached to the hub of the detent and extending therefrom;

a flexible arm having a proximal end attached to the hub of the detent and a distal end extending from the detent, the distal end attachable to the carburetor; and a first member moveable with respect to the detent in a first direction to contact the rigid arm, and further moveable in the first direction to displace the rigid arm in a second direction substantially transverse to the first direction, thereby causing the flexible arm to bend and the detent to rotate relative to the carburetor.

23. The throttle control system of claim 22, wherein the first member comprises a screw having a slanted head, the screw being adapted to screw into the carburetor and thereby move relative to the rigid arm of the detent.

24. The throttle control system of claim 23, wherein the throttle lever further comprises a hole that substantially aligns with the screw when the throttle lever is in a position corresponding to an idle state of the throttle valve, thereby allowing access to the screw.

25. A throttle control system for a carburetor comprising:

a throttle valve shaft rotatably coupled to the carburetor, wherein rotating the throttle valve shaft in a first direction tends to open the carburetor, and rotating the throttle valve shaft in a second direction opposite the first direction tends to close th e carburetor;

a throttle lever having a hub section coupled to the throttle valve shaft; and a detent;

wherein the detent indexes the hub section of the throttle lever relative to the carburetor in at least a first, a second, and a third position, the first and second positions being within a 4° rotation of the throttle valve shaft, and the first and third positions being within a 14° rotation of the throttle valve shaft.

26. The throttle control system of claim 25, wherein the first and second positions correspond to an open state and an idle state of the throttle valve, respectively.

27. The throttle control system of claim 25, wherein the detent indexes the hub section of the throttle lever in a third position corresponding to a wide open throttle state of the throttle valve.

28. A throttle control system for a carburetor comprising:

a throttle valve shaft attachable to a throttle valve of the carburetor;

a throttle lever having an arm section and a hub section, the hub section comprising an annular recess circumscribed by an annular rim, wherein at least two notches are formed in the annular rim; and a detent rotationally fixable relative to the carburetor, the detent comprising a protrusion shaped to mate with each of the at least two notches in the annular rim, wherein the throttle valve shaft is rotatable with respect to the detent, the hub section of the throttle lever is fixed to the throttle valve shaft, and the detent is at least partially located within the annular recess of the hub section of the throttle lever, and further wherein when the throttle lever is rotated with respect to the detent, the notches of the throttle lever move with respect to the protrusion of the detent, and when one of the at least two notches indexes the protrusion, the protrusion mates with the one of the at least two notches, thereby positively indexing the throttle lever, wherein the angular position of the detent about the throttle valve shaft is manually adjustable, thereby allowing the idle state of the throttle valve to be adjusted, and wherein the detent comprises:

a hub;

a rigid arm attached to the hub of the detent and extending therefrom;

a flexible arm having a proximal end attached to the hub of the detent and a distal end extending from the detent, the distal end attachable to the carburetor; and a first member moveable with respect to the detent in a first direction to contact the rigid arm, and further moveable in the first direction to displace the rigid arm in a second direction substantially transverse to the first direction, thereby causing the flexible arm to bend and the detent to rotate relative to the carburetor.

29. The throttle control system of claim 28, wherein the first member comprises a screw having a slanted head, the screw being adapted to screw into the carburetor and thereby move relative to the rigid arm of the detent.

30. The throttle control system of claim 29, wherein the throttle lever further comprises a hole that substantially aligns with the screw when the throttle lever is in a position corresponding to an idle state of the throttle valve, thereby allowing access to the screw.

31. A throttle control system for attaching to and rotating a throttle valve shaft of a carburetor, the throttle valve shaft operationally coupled to a throttle valve of a carburetor so that rotating the throttle valve shaft with respect to the carburetor opens or closes the throttle valve, the throttle control system comprising:

a throttle lever attachable to the throttle valve shaft, the throttle lever having an arm section and a hub section, the hub section comprising an annular recess circumscribed by an annular rim, wherein at least two notches are formed in the annular rim; and a detent rotationally fixable relative to the carburetor, the detent comprising a protrusion shaped to mate with each of the at least two notches in the annular rim, wherein the detent is at least partially located within the annular recess of the hub section of the throttle lever, and wherein when the throttle lever is rotated with respect to the detent, the notches of the throttle lever move with respect to the protrusion of the detent, and when one of the at least two notches indexes the protrusion, the protrusion mates with the one of the at least two notches, thereby positively indexing the throttle lever, wherein the angular position of the detent about the throttle valve shaft is manually adjustable, thereby allowing the idle state of the throttle valve to be adjusted, and wherein the detent further comprises:

a hub;

a rigid arm attached to the hub of the detent and extending therefrom;

a flexible arm having a proximal end attached to the hub of the detent and a distal end extending from the detent, the distal end attachable to the carburetor; and a first member moveable with respect to the detent in a first direction to contact the rigid arm, and further moveable in the first direction to displace the rigid arm in a second direction substantially transverse to the first direction, thereby causing the flexible arm to bend and the detent to rotate relative to the carburetor.

32. The throttle control system of claim 31, wherein the first member comprises a screw having a slanted head, the screw being adapted to screw into the carburetor and thereby move relative to the rigid arm of the detent.

33. The throttle control system of claim 32, wherein the throttle lever further comprises a hole that substantially aligns with the screw when the throttle lever is in a position corresponding to an idle state of the throttle valve, thereby allowing access to the screw.

* * * * *